US009007150B2

(12) United States Patent
Zhu et al.

(10) Patent No.: US 9,007,150 B2
(45) Date of Patent: Apr. 14, 2015

(54) TM MODE RF FILTER HAVING DIELECTRIC ROD RESONATORS WITH CYLINDRICAL PARTS OF DIFFERENT DIAMETER

(75) Inventors: Mafeng Zhu, Wuxi (CN); Yan Zhang, Chengdu (CN)

(73) Assignee: Telefonaktiebolaget L M Ericsson (Publ), Stockholm (SE)

( * ) Notice: Subject to any disclaimer, the term of this patent is extended or adjusted under 35 U.S.C. 154(b) by 334 days.

(21) Appl. No.: 13/378,568

(22) PCT Filed: Jun. 17, 2009

(86) PCT No.: PCT/SE2009/050760

§ 371 (c)(1),
(2), (4) Date: Dec. 15, 2011

(87) PCT Pub. No.: WO2010/147523

PCT Pub. Date: Dec. 23, 2010

(65) Prior Publication Data

US 2012/0092089 A1 Apr. 19, 2012

(51) Int. Cl.

| | |
|---|---|
| ***H01P 1/20*** | (2006.01) |
| ***H01P 7/10*** | (2006.01) |
| ***H01P 1/208*** | (2006.01) |

(52) U.S. Cl.

CPC ..... *H01P 7/10* (2013.01); *H01P 1/2084* (2013.01)

(58) Field of Classification Search

CPC ..... H01P 1/2082; H01P 1/2084; H01P 7/10
USPC ..... 333/202, 219.1
See application file for complete search history.

(56) References Cited

U.S. PATENT DOCUMENTS

| | | | | |
|---|---|---|---|---|
| 4,626,809 | A * | 12/1986 | Mizumura et al. | 333/202 |
| 2004/0051602 | A1 | 3/2004 | Pance et al. | |
| 2006/0097825 | A1 * | 5/2006 | Kurisu et al. | 333/219.1 |
| 2006/0186972 | A1 * | 8/2006 | Pance et al. | 333/235 |

FOREIGN PATENT DOCUMENTS

| | | | |
|---|---|---|---|
| EP | 0060174 | A1 | 9/1982 |
| EP | 0923151 | A1 | 6/1999 |
| WO | 2004102730 | A2 | 11/2004 |
| WO | 2004102730 | A3 | 11/2004 |

OTHER PUBLICATIONS

A.G. Mann et al., Ultra-Stable Cryogenic Sapphire Dielectric Microwave Resonators, Proc. 1992 IEEE Frequency Control Symposium, 1992, pp. 167-171, IEEE.

(Continued)

*Primary Examiner* — Benny Lee
(74) *Attorney, Agent, or Firm* — Patent Portfolio Builders PLLC

(57) ABSTRACT

The invention relates to a dielectric resonator rod in a transverse magnetic mode radio frequency filter comprising a first cylindrical end part (10) of a first diameter (D1) and a second cylindrical end part (20) of a second diameter (D2). The first diameter is different than the second diameter and the first cylindrical end part (10) is connected via a third intermediate part (30) to the second cylindrical end part (20). The third intermediate part (30) comprises a tapered outer circumferential surface connecting the first cylindrical end part (10) to the second cylindrical end part (20).

13 Claims, 5 Drawing Sheets

(56) References Cited

OTHER PUBLICATIONS

A.K. Ahmed et al., Conical Dielectric Resonator Antennas for Wide-Band Applications, Trans. Antennas and Propagation, Apr. 2002, pp. 469-474, IEEE.

Swedish Patent Office, International Search Report in PCT/SE2009/050760, Feb. 18, 2010.

Swedish Patent Office, Written Opinion in PCT/SE2009/050760, Feb. 18, 2010.

Extended European Search Report mailed on Oct. 11, 2012 in related Application No. EP 09846265.8.

* cited by examiner

TM MODE RF FILTER HAVING DIELECTRIC ROD RESONATORS WITH CYLINDRICAL PARTS OF DIFFERENT DIAMETER

TECHNICAL FIELD

The present solution relates to the field of radio frequency filters. In particular, to a dielectric resonator rod in a transverse Magnetic Mode Radio Frequency filter.

BACKGROUND

Radio Frequency (RF) filters are widely used in modern communication systems to perform filtering of signals. In a Frequency Division Duplex (FDD) working system, filters also function to combine the power of a number of channels into a composite wideband signal for transmission via a common antenna.

The traditional technology for RF filter design is based on coaxial resonators. They have been developed for decades and have been operating on most of communication systems, especially on Radio Base Stations (RBS). They are easy to design, manufacture and maintain, but is not a unique solution. One type of RF filters is ceramic filters or Dielectric Resonator (DR) filters. Using DR filters enables manufacturers to shrink the RF filters substantially. By shrinking the filter volume, smaller products may be designed and a DR filter is assembled by arranging ceramic parts, such as pucks, discs, rods or the like, into a rigid housing or a sheet metal housing.

The DR filters are becoming more and more popular for wireless communication system because of the better performance. It has been proven that DR filters have many advantages compared with traditional coaxial filters. One of the most attractive properties lies in the fact that it can make the RF filter compact in size.

For Transverse Magnetic (TM) mode resonators, DR filters can be made even smaller if step resonators are applied, so called Step Diameter Section (SDS) structure. But this advantage comes with one obvious drawback, from the technical point of view, that of poor spurious performance. The spurious band of DR filters is much closer to the operating frequency band than that of traditional filters. The spurious problem is attributed to the working mode of a dielectric resonator. Theoretically, one dielectric resonator can support a variety of resonant modes, which causes the frequency spacing between the desired fundamental resonant mode frequency and higher-order resonant modes frequency to be quite narrow.

In order to benefit from reducing filter volume, dielectric resonators are more and more widely used in filter design, and a Low Pass Filter (LPF) is always applied in a DR filter to suppress spurious emissions. But due to the LPF's long transition band from pass band to stop band, the frequency of higher-order resonant modes for a resonator; (that is, the spurious band for a filter accordingly, close to the frequency of fundamental resonant mode) is difficult to suppress, and is still very harmful to filter unit (FU) design.

SUMMARY

An aspect of embodiments herein is to provide a mechanism that improves the compactness of a TM mode RF filter with good spurious performance.

According to a first embodiment, a dielectric resonator rod in a transverse magnetic mode radio frequency filter is provided. The dielectric resonator rod comprises a first cylindrical end part of a first diameter and a second cylindrical end part of a second diameter. The first diameter is different that the second diameter. Additionally, the first cylindrical end part is connected, via a third intermediate part, to the second cylindrical end part. The third intermediate part comprises a tapered outer circumferential surface connecting the first cylindrical end part to the second cylindrical end part. The tapered outer circumferential surface results in that filtered signals comprises a higher order resonant mode frequency that is separated from a fundamental resonant mode frequency by such a range that it is facilitated to filter out the higher order resonant mode frequency using a low band pass filter.

According to a second embodiment, a method is provided in a transverse Magnetic Mode Radio Frequency filter for filtering an input radio frequency signal to an output radio frequency signal of a fundamental resonant frequency band. The input radio frequency signal is input into the transverse Magnetic Mode Radio Frequency filter. The input radio frequency signal is then filtered travelling along the interior of the transverse Magnetic Mode Radio Frequency filter. The transverse Magnetic Mode Radio Frequency filter comprises at least one dielectric resonator rod comprising a first cylindrical end part of a first diameter and a second cylindrical end part of a second diameter. The first diameter is different than the second diameter. Furthermore, the first cylindrical end part is connected via a third intermediate part to the second cylindrical end part, wherein the third intermediate part comprises a tapered outer circumferential surface connecting the first cylindrical end part to the second cylindrical end part.

A higher-order mode signal of the filtered input radio frequency signal is further filtered out using a low pass filter. This may be performed before or after input into the transverse Magnetic Mode Radio Frequency filter. The method results in a filtered output radio frequency signal of the fundamental resonant frequency band.

The claimed technique presents a special structure of dielectric resonators to improve the spurious suppression, which is working on Transverse Magnetic (TM) mode. The special structure can greatly make the high order resonant modes separate farther from fundamental resonant mode than prior art TM mode resonators, a normal LPF is enough to suppress the spurious, that is, the high resonant modes, before or after the dielectric resonators. As a result a TM mode RF filter of a very compact design and still with accurate filtering may be provided.

BRIEF DESCRIPTION OF THE DRAWINGS

Embodiments will now be described in more detail in relation to the enclosed drawings, in which.

DETAILED DESCRIPTION

The present solution presents a special structure of Dielectric Resonator rods to improve the spurious suppression, which is working on Transverse Magnetic (TM) mode. The structure can better separate the frequency of higher-order resonance farther from that of fundamental resonance than would a normal TM mode step resonator would. As a result, sending the filtered signal through a normal Low Pass Filter (LPF) is enough to suppress the high resonant modes.

The step structure of a dielectric resonator rod may reduce the volume of resonant cavity with poor spurious performance, and then reduce the total volume of filter by about 40%. The basic concept of the present solution is to provide a dielectric resonator with better spurious performance. So, tapered dielectric resonator, which means infinite, is provided achieving a better spurious performance.

Figure 1:
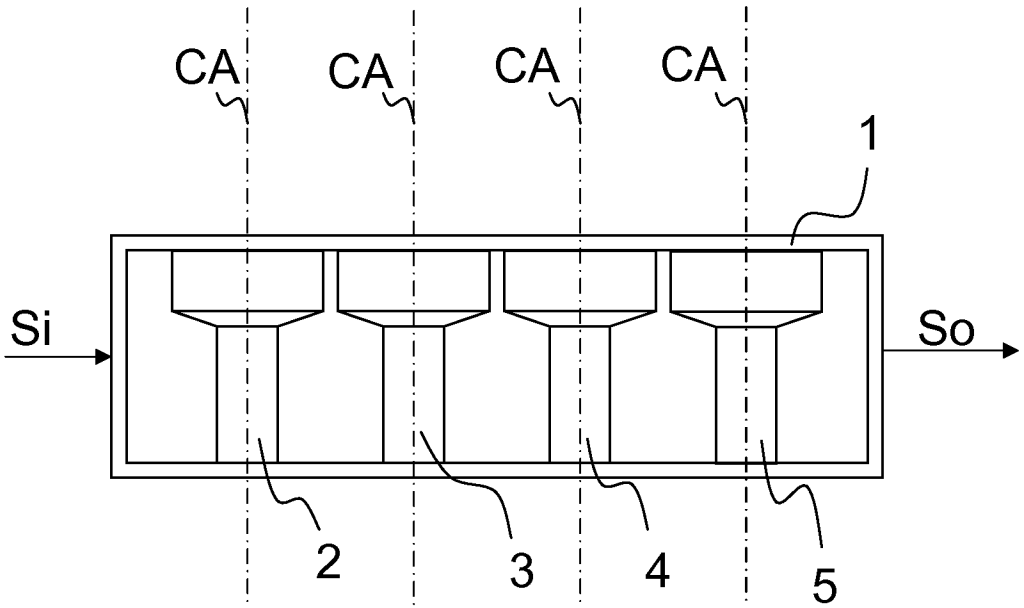
FIG. 1 shows a schematic cross sectional view of a radio frequency filter.

FIG. 1 shows a cross sectional view of a transverse Magnetic Mode Radio Frequency filter. The transverse Magnetic Mode Radio Frequency (TM RF) filter comprises a filter housing 1 and one or a plurality of Dielectric Resonator rods 2, 3, 4, 5. The Dielectric Resonators rods 2-5 are elongated circular rods as indicated by the illustrated Center Axis (CA). The RF signal is sent into the transverse Magnetic Mode Radio Frequency filter indicated as Si and is filtered within the transverse Magnetic Mode Radio Frequency filter and through the Dielectric Resonators rods 2-5. The RF signal is then output as a band filtered signal So from the transverse Magnetic Mode Radio Frequency filter, wherein the So is a signal within a fundamental frequency band, that is, an operational passband.

The dielectric resonators are circular rods comprising two different sections of different diameters and these end parts are interconnected via a tapered intermediate part. The three sections of the dielectric resonator may share the same Centre Axis (CA). The tapered intermediate part comprises a circumferential surface arranged with an angle to the CA. The tapered intermediate part eliminates or weakens some higher-order resonant frequencies and results in that the frequency spacing between the frequency of higher-order resonant mode for the filter, that is, the spurious band for the filter, is separated farther from the frequency of fundamental resonant mode. The frequency spacing is increased in some embodiments to a range of 800-1300 MHz. This frequency of higher-order resonant mode is at such frequency distance that a low band pass filter may be used to filter such a frequency out without interfering with the fundamental resonant frequency band.

A compact resonator structure working in the TM mode with good spurious performance is thereby provided. The tapered intermediate part can make the resonator much smaller than with a prior art structure, while the performance, mainly for Quality Factor, Q, is as good as, or even better than the Q factor in the prior art, which is the most important indicator for a resonator.

As stated in prior art the SDS (Step Diameter Section) structure reduces the volume of resonant cavity, but has degraded spurious performance. This means that the higher-order mode will be very close to the fundamental resonant frequency. The fundamental resonant frequency is the operating frequency and, to avoid interference, the higher-order modes, which are also referred to as spurious herein, requires to be suppressed. The closer the spurious is the fundamental resonant frequency, the harder it is to suppress the spurious. The tapered dielectric resonator rod, which means gradual/continuous change between two steps, can make the spurious much farther away from operating frequency and hence facilitate the spurious filtering.

Figure 2:
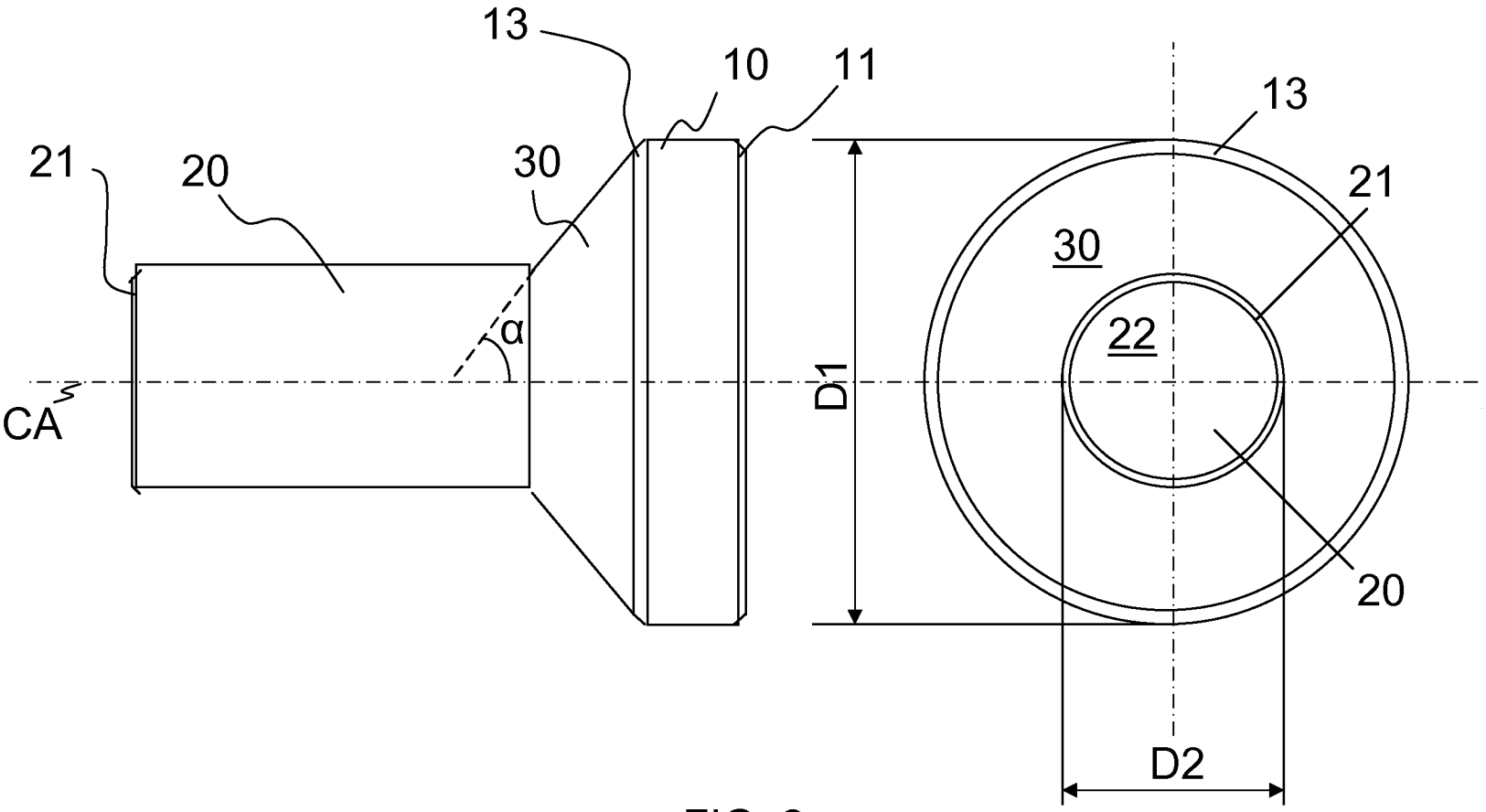
FIG. 2 shows a schematic overview of a dielectric resonator.

FIG. 2 shows an embodiment of one of the tapered dielectric resonator rod structures working on the TM mode at resonant frequency around 2.4 GHz in a side view and a bottom view. The gradual change from a greater outer diameter, a first diameter D1, to a smaller outer diameter, a second diameter D2, is continuous and smooth, this kind of structure is called tapered dielectric resonator.

The dielectric resonator rod structure comprises a first circular end part with chamfers 11 and 13 and a second circular end part 20 with a chamfer 21. The first end part 10 comprises the first diameter D1 that is larger than the second diameter D2 of the second end part 20. The first end part 10 is connected to the second end part 20 via a third intermediate part 30. The third intermediate part 30 comprises a tapered circumferential surface smoothing out the transition of the diametric change from the first diameter D1 to the second diameter D2.

In the illustrated example, the first cylindrical end part 10, the second cylindrical end part 20, and the third intermediate part 30 share the same center axis CA. The tapered outer circumferential surface is arranged with an angle a of at least one degree in relation to the center axis CA, and the illustrated example shows an example wherein the third intermediate part 30 comprises a cone like shaped circumferential surface connecting the first end part 10 with the second end part 20. The angle a may be in the range of 30-70 degrees to form a cone liked shaped circumferential surface.

The chamfers 11,13 and 21 are arranged to facilitate the manufacturing of the dielectric resonator and improve the performance of resonators. Dielectric Resonators or ceramic resonators are manufactured in mass production by die-casting. By the arranged chamfers 11, 13, 21 the dielectric resonator rods are easy for releasing from the mold, and the surface and edges of resonators are facilitated to get better quality, thus enhancing performance. The dimensions of the different parts, such as length and diameters are chosen according to different required fundamental resonant frequency of the dielectric resonator. Generally speaking, in order to keep working in the TM mode, the thickness of part 10 should be much smaller compared its diameter D1, and the part 20 should be longer compared with its diameter D2. In an embodiment, dimension relationship of the diameters D1 and D2 may be D1/D2-2/1, for example, D1=18 mm, D2=9 mm; the length of the first end part 10 is 3 mm, the length of the intermediate part is 4 mm; and the length of the second end part 20 is 13 mm.

The dielectric resonator may be silver coated and comprise adhesive on an end side 22 of the second end part 20. The dielectric resonator rod may be fixed to the housing of the TM mode RF filter by the adhesive on the end side 22 or by soldering. The dielectric rod may also comprise a cavity along the center axis CA of the first end part 21. A tuning screw may be inserted into the cavity to tune the TM mode RF filter. The tuning screw changes the resonator frequency and decreases the unloaded Q factor a little.

It should be noted that modern ceramic materials and silver coatings cause low insertion loss, excellent temperature stability, wide frequency range and small size and the fundamental resonant frequency is primary adjusted by the size and thickness of the dielectric resonator rod.

The dielectric resonator structure of FIG. 2 expands the interval or spacing between the fundamental resonant frequency and the lowest higher-order mode frequency. That makes TM DR Filters practical for most communication systems with good spurious performance.

Figure 3:
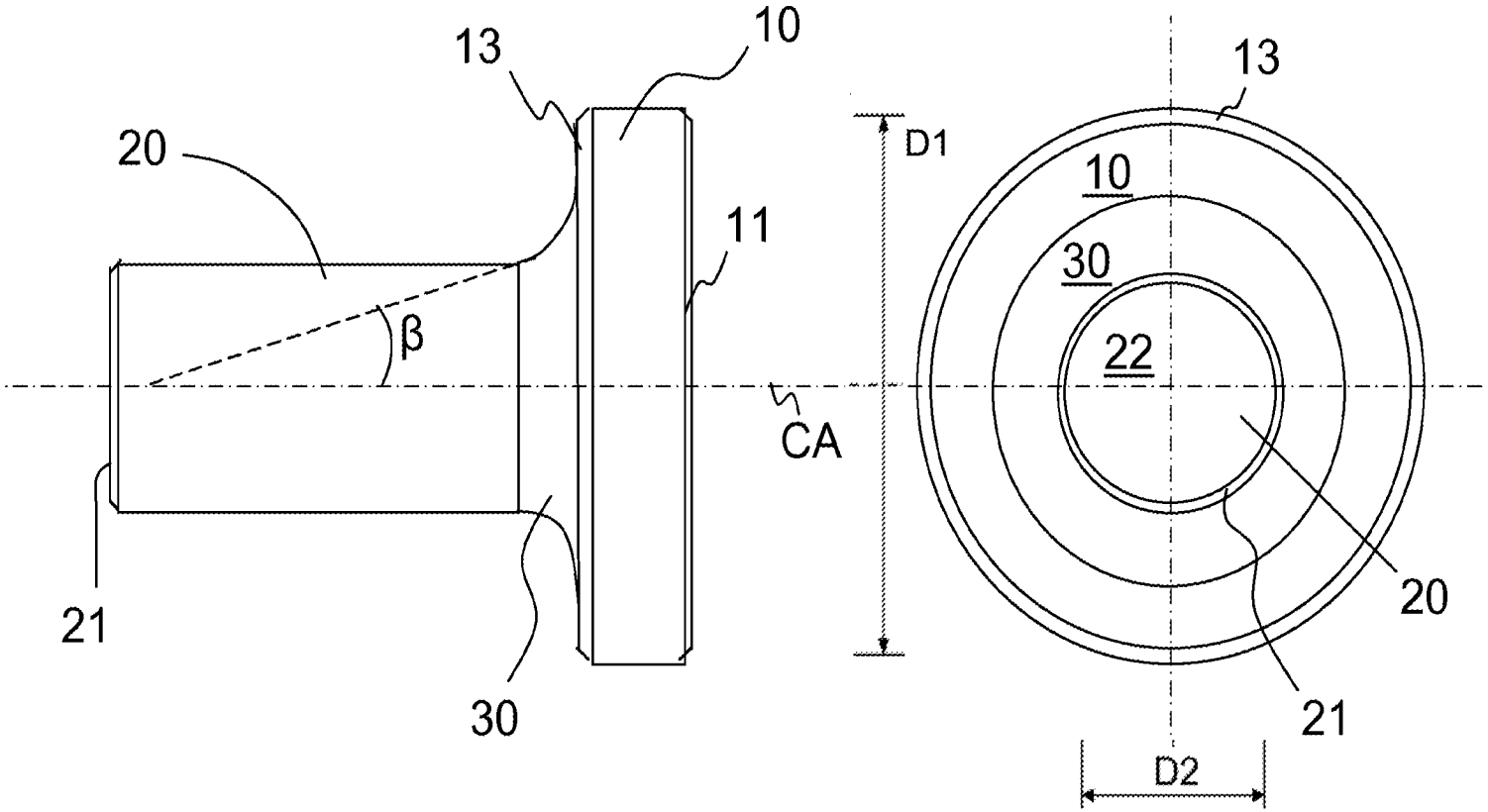
FIG. 3 shows a schematic overview of a dielectric resonator.

FIG. 3 shows another type of tapered dielectric resonator rod structure in a side view and a bottom view. The tapered dielectric resonator rod structure comprises circular arranged chamfers 11, 13, 21 avoiding sharp edges. The changing circumferential surface of the intermediate part 30 between the two different diameters can be any type of curve.

In the illustrated example, as in the structure if FIG. 2, the first cylindrical end part 10, the second cylindrical end part 20, and the third intermediate part 30 share the same center axis CA. The tapered outer circumferential surface is arranged with an angle of at least one degree in relation to the center axis CA.

In some embodiments, the tapered outer circumferential surface is arranged to elongate along the center axis CA with an increasing angle β to the center axis CA toward the first cylindrical end part 10, and the first diameter D1 is longer than the second diameter D2. The tapered outer circumferential surface may be arranged to elongate as an exponential curve towards the first diameter D1 or any other continuous curve.

The first cylindrical end part 10 may comprise a first chamfer 11 and a second chamfer 13 arranged along each circular end edge of the first cylindrical end part 10. The dielectric resonator rod may further comprise an adhesive on an end side 22 of the second end part 20.

The second cylindrical end part 20 may also comprise a chamfer arranged along a circular end edge of the second cylindrical end part 20.

The dielectric resonator rod structure of FIG. 3 expands the interval or spacing between the fundamental resonant frequency and the lowest higher-order mode frequency. That makes TM DR Filters practical for most communication systems with good spurious performance. The embodiments above are especially for Time Division Duplex-Long Term Evolution (TD-LTE) system.

Furthermore, at least one dielectric resonator rod is to be arranged and assembled in the housing of a transverse Magnetic Mode Radio Frequency filter. The transverse Magnetic Mode Radio Frequency filter may comprise other resonators, such as traditional metal coaxial resonators.

Simulation results show that the tapered dielectric resonator rod has competitive performance such as volume and quality factor. And the most significant improvement is the frequency spacing between fundamental mode and lowest high-order mode. The present solution increases Frequency Spacing between fundamental mode and lowest higher-order mode compared with normal step TM DR.

Figure 4:
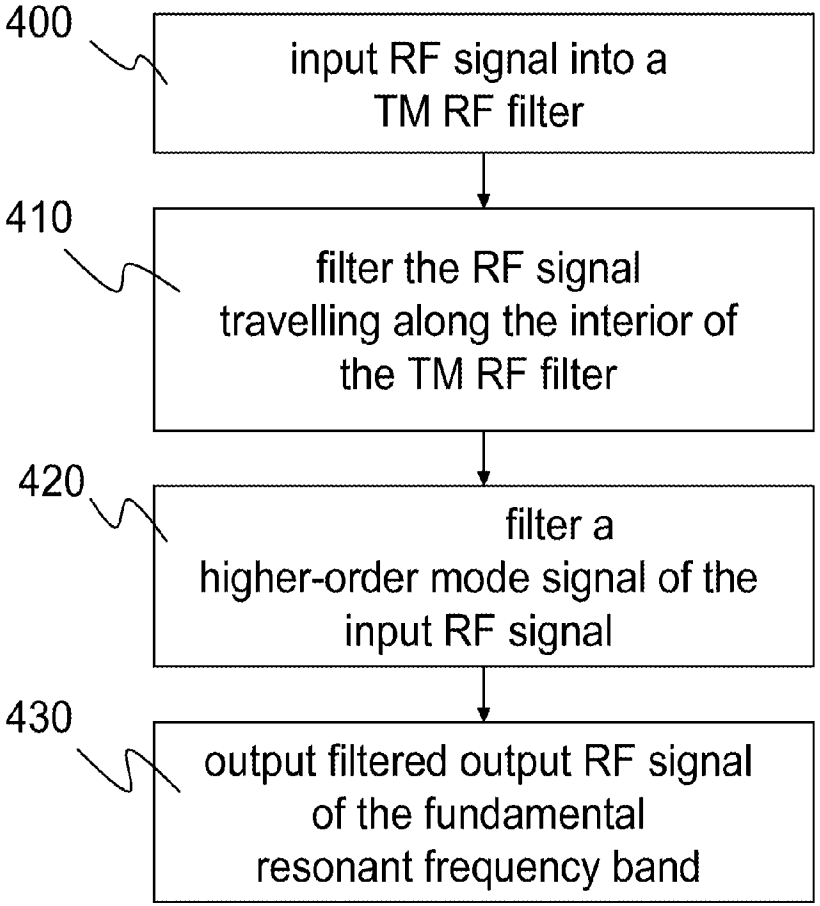
FIG. 4 shows a schematic flowchart of a method for filtering a radio frequency signal.

The method steps performed on the radio frequency (RF) signal (Si) for filtering the Si according to some embodiments will now be described with reference to a flowchart depicted in FIG. 4. The method steps do not have to be taken in the order stated below, but may be taken in any suitable order.

In step 400, the RF signal Si is input to the TM mode RF filter. The TM mode RF filter is actually a bandpass filter with sharp filter characteristic. The definition of a bandwidth of a dielectric ceramic filter is the frequency gap where the signal has dropped less than 3 dB.

In step 410, the RF signal is filtered travelling along the interior of the TM mode RF filter. The TM mode RF filter comprises, for example, at least one dielectric resonator rod 2 as described in FIGS. 2 and 3 comprising a first cylindrical end part 10 of a first diameter D1 and a second cylindrical end part 20 of a second diameter D2. The first diameter D1 is different that the second diameter D2 and the first cylindrical end part 1 is connected via a third intermediate part to the second cylindrical end part 20. The third intermediate part 30 comprises a tapered outer circumferential surface connecting the first cylindrical end part 10 with the second cylindrical end part 20. The tapered intermediate part 30 separates the frequencies because it eliminates or attenuates some of the lowest higher-order resonant modes.

In step 420, the filtered RF signal is sent through a low pass filter and a higher-order resonant mode signal of the RF signal is filtered to remove spurious emissions. Since the TM mode filter with the tapered dielectric resonator rods results in a signal with higher mode resonant frequency separated much farther away from the fundamental resonant frequency as the lower higher mode resonant frequencies are eliminated, it facilitates the attenuation of the higher mode resonant frequency. For example, in a case using a dielectric resonator rod of a D=25 mm with a height of 25 mm and the resonant frequency around 2.4 GHz, the frequency spacing between fundamental mode and lowest higher-order mode is 800-1300 MHz. The frequency spacing of using a step diameter section structure but not tapered dielectric resonator rod is 650 MHz. An improvement of 20-115% of the frequency spacing may be achieved and also an improvement of the quality factor may also be achieved using the tapered dielectric rod.

In step 430, the spurious filtered RF signal is output as the output RF signal of the fundamental resonant frequency band.

By letting through frequencies farther separated from the fundamental resonant frequency band the low pass filter may attenuate these frequencies before or after the TM mode RF filter, though the low pass filter comprises a long transition band from pass band to stop band.

Figure 5:
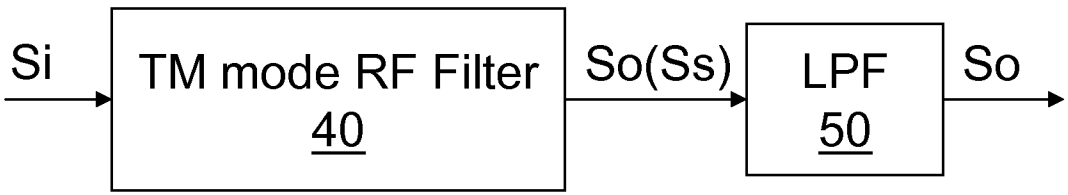
FIG. 5 shows a schematic arrangement to filter a radio frequency signal.

In FIG. 5, a schematic overview of band filtering the RF signal to the RF signal of the fundamental resonant frequency band is shown.

The RF signal Si is sent through a TM mode RF filter 40 comprising at least one dielectric resonator rod 2 described above. The dielectric resonator rod 2 as described in FIGS. 2 and 3 comprises a first cylindrical end part 10 of a first diameter D1 and a second cylindrical end part 20 of a second diameter D2. The first diameter D1 is different that the second diameter D2 and the first cylindrical end part 10 is connected via a third intermediate part 30 to the second cylindrical end part 20. The third intermediate part 30 comprises a tapered outer circumferential surface connecting the first cylindrical end part 10 with the second cylindrical end part 20. The RF signal is filtered travelling along the interior of the TM mode RF filter 40 into an output RF signal So but may still comprise a frequency of higher-order resonant mode signal Ss passed through the TM mode RF filter 40. The RF output signal So comprising the higher order resonant mode signal Ss is then filtered through a Low pass Filter 50, removing the frequency band of the higher order resonant mode signal Ss without interfering with the fundamental resonant frequency band, resulting in a filtered RF output signal So of the fundamental resonant frequency band. The order of the filtering performed by elements 40 and 50 may be interchanged. Thus, the LPF 50 may first attenuate the signal Si to a signal of a certain band and the TM mode filter will only pass the fundamental frequency having tapered dielectric resonator rods that only has spurious of higher order resonant frequency already filtered in the LPF 50.

In the drawings and specification, there have been disclosed exemplary embodiments of the invention. However, many variations and modifications can be made to these embodiments without substantially departing from the principles of the present invention. Accordingly, although specific terms are employed, they are used in a generic and descriptive sense only and not for purposes of limitation, the scope of the invention being defined by the following claims.

The invention claimed is:

1. A dielectric resonator rod for a transverse magnetic mode radio frequency filter, comprising:

a first cylindrical end part having a first diameter, wherein the first cylindrical end part comprises at least one chamfer arranged along at least one circular end edge of the first cylindrical end part;

a second cylindrical end part having a second diameter that is different from the first diameter; and a third intermediate part, wherein the first cylindrical end part is connected via the third intermediate part to the second cylindrical end part, and the third intermediate part comprises a tapered outer circumferential surface connecting the first cylindrical end part to the second cylindrical end part.

2. The dielectric resonator rod of claim 1, wherein the third intermediate part comprises a cone-like circumferential surface.

3. The dielectric resonator rod of claim 1, wherein the tapered outer circumferential surface elongates along the center axis of the dielectric resonator rod with an angle to the center axis that increases toward the first cylindrical end part, and the first diameter is greater than the second diameter.

4. The dielectric resonator rod of claim 3, wherein the tapered outer circumferential surface elongates as a continuous curve toward the first diameter.

5. A device, comprising a filter housing and at least one dielectric resonator rod according to claim 1 in the filter housing.

6. The device of claim 5, wherein a second cylindrical end part of the at least one dielectric rod comprises a chamfer arranged along a circular end edge of the second cylindrical end part.

7. The dielectric resonator rod of claim 1, wherein the first cylindrical end part, the second cylindrical end part, and the third intermediate part are arranged such that they have a common center axis, and the tapered outer circumferential surface is arranged with an angle of at least one degree in relation to the center axis.

8. The dielectric resonator rod of claim 7, wherein the third intermediate part comprises a cone-like circumferential surface.

9. The dielectric resonator rod of claim 7, wherein the tapered outer circumferential surface elongates along the center axis with an angle to the center axis that increases toward the first cylindrical end part, and the first diameter is greater than the second diameter.

10. The dielectric resonator rod of claim 9, wherein the tapered outer circumferential surface elongates as a continuous curve toward the first diameter.

11. The dielectric resonator rod of claim 1, wherein the second cylindrical end part comprises a chamfer arranged along a circular end edge of the second cylindrical end part.

12. A method in a transverse magnetic mode radio frequency (RF) filter of filtering an input RF signal to an output RF signal of a fundamental resonant frequency band, comprising:

inputting the input RF signal into the transverse magnetic mode RF filter;

filtering the input RF signal travelling along an interior of the filter, wherein the filter comprises at least one dielectric resonator rod comprising a first cylindrical end part having a first diameter, a second cylindrical end part having a second diameter that is different from the first diameter, and a third intermediate part having a tapered outer circumferential surface connecting the first cylindrical end part to the second cylindrical end part, wherein the first cylindrical end part comprises at least one chamfer arranged along at least one circular end edge of the first cylindrical end part;

filtering a higher-order-mode signal of the input RF signal using a low pass filter to remove spurious effects; and outputting the output RF signal of the fundamental resonant frequency band.

13. The method of claim 12, wherein the second cylindrical end part comprises a chamfer arranged along a circular end edge of the second cylindrical end part.

* * * * *